United States Patent [19]

von Laar et al.

[11] Patent Number: 4,974,491

[45] Date of Patent: Dec. 4, 1990

[54] AUTOMATIC MUZZLE LOADER WEAPON

[75] Inventors: Klaus von Laar, Espenau-Hohenkirchen; Wilhelm Machmer, Nuremberg, both of Fed. Rep. of Germany

[73] Assignee: Diehl GmbH & Co., Nuremberg, Fed. Rep. of Germany

[21] Appl. No.: 442,128

[22] Filed: Nov. 28, 1989

[30] Foreign Application Priority Data

Dec. 7, 1988 [DE] Fed. Rep. of Germany ..... 3841195

[51] Int. Cl.[5] ..... F41A 9/48

[52] U.S. Cl. ..... 89/37.05; 89/1.3; 89/33.03; 89/47

[58] Field of Search ..... 89/45, 46, 47, 1.35, 89/37.05, 33.03, 1.3; 42/51

[56] References Cited

U.S. PATENT DOCUMENTS

| | | | |
|---|---|---|---|
| 1,294,636 | 2/1919 | Dovell | 89/33.03 |
| 1,500,711 | 7/1924 | Lafitte | 89/37.05 |
| 1,723,623 | 8/1929 | Kennedy | 89/37.05 |
| 2,088,503 | 7/1937 | Broussard | 89/33.03 |
| 3,068,755 | 12/1962 | Johnstone et al. | 89/1.3 |
| 3,130,638 | 4/1964 | Horton, Jr. et al. | 89/47 |
| 3,210,931 | 10/1965 | Elzufon et al. | 89/33.03 |
| 3,818,794 | 6/1974 | Mayer et al. | 89/45 |
| 4,011,794 | 3/1977 | Leshem | 89/47 |
| 4,495,852 | 1/1985 | Winkler et al. | 89/46 |
| 4,572,076 | 2/1986 | Politzer et al. | 102/431 |
| 4,669,357 | 6/1987 | von Laar et al. | 89/45 |

FOREIGN PATENT DOCUMENTS

| | | | |
|---|---|---|---|
| 66192 | 12/1982 | European Pat. Off. | 89/37.05 |
| 329878 | 12/1920 | Fed. Rep. of Germany | 89/45 |
| 3436369 | 4/1986 | Fed. Rep. of Germany | 89/46 |

*Primary Examiner*—Charles T. Jordan
*Assistant Examiner*—Stephen Johnson
*Attorney, Agent, or Firm*—Scully, Scott, Murphy & Presser

[57] ABSTRACT

An automatic muzzle or front loader weapon which possesses a weapon barrel which is pivotable in the direction of elevation or firing, and including a front or leading barrel segment which is latchable with the weapon barrel so as to be in coaxial alignment therewith. The barrel segment is pivotable into a loading position relative to the weapon barrel and which aligns with a loading tray into which there is insertable a projectile which is received from a storage magazine, whereby the projectile is slidable into the front barrel segment from the loading tray, whereupon the front barrel segment will then pivot in such a manner so as to cause the projectile to slide into the weapon barrel.

7 Claims, 1 Drawing Sheet

AUTOMATIC MUZZLE LOADER WEAPON

BACKGROUND OF THE INVENTION

1. Field of the Invention

The present invention relates an automatic muzzle or front loader weapon which possesses a weapon barrel which is pivotable in the direction of elevation or firing, and including a front or leading barrel segment which is latchable with the weapon barrel so as to be in coaxial alignment therewith, wherein the barrel segment is pivotable into a loading position relative to the weapon barrel and which aligns with a loading tray into which there is insertable a projectile which is received from a storage magazine, whereby the projectile is slidable into the front barrel segment from the loading tray, whereupon the front barrel segment will then pivot in such a manner so as to cause the projectile to slide into the weapon barrel.

2. Discussion of the Prior Art

A muzzle or front loader weapon of that type is described in German Laid-Open Patent Appln. 34 40 467. In that instance, there is proceeded from the assumption that the projectile encompasses the propellent charge.

In the disclosure of German Laid-Open Patent Appln. No. 33 09 288 there is described an article of ammunition in which the projectile possesses a directly attached component consisting of a propellent charge, which is then completed by a base charge which is separate from the projectile. As a result, there is achieved that through the use of a single weapon there can be fired different types of projectiles of the same caliber.

SUMMARY OF THE INVENTION

Accordingly, it is an object of the present invention to propose a muzzle or front loader weapon of the above-mentioned type in which the projectiles and the propellent charge constituents are maintained in separate storage magazines, and in which a projectile and a selected propellent charge component can be commonly conveyed to the weapon barrel.

Inventively, the above-mentioned object is achieved for a muzzle or front loader weapon of the above-mentioned type in that a propellent charge component which is suitable for the projectile is stored in a further magazine, which has a transport device associated therewith by means of which a selected propellent charge component can be brought onto the side of the loading tray which is remote from the front barrel segment, and wherein there is provided a pusher or ramming device through the intermediary of which the propellent charge component can be slid against a projectile which is located in the loading tray, and through which the projectile together with the propellent charge component can then be slid into the front barrel segment which is oriented in the loading position.

In view of the foregoing, it is then possible to have a projectile of a preselected type of projectiles associated on the loading tray with a propellent charge component which is in particular selected in accordance with the contemplated firing range, and in which the projectile is transported concurrently with the propellent charge component to the weapon barrel. The conveyance towards the weapon barrel is hereby effectuated in a rapid and secure manner. It is also expedient that the deployment of the projectile and the propellent charge component from the storage magazines towards the loading tray can be carried out in a computer controlled manner.

The muzzle or front loader weapon with the two magazines can be installed in the interior space of an armored vehicle. It is also expedient that with this muzzle or front loader weapon, there will not be encountered in the interior of the vehicle during the firing of the projectile any problems of smoke or gas caused by the propellent charge component.

BRIEF DESCRIPTION OF THE DRAWINGS

Advantageous embodiments of the invention can now be readily ascertained from the following detailed description of an exemplary embodiment thereof, taken in conjunction with the accompanying drawings; in which.

DETAILED DESCRIPTION

Figure 1:
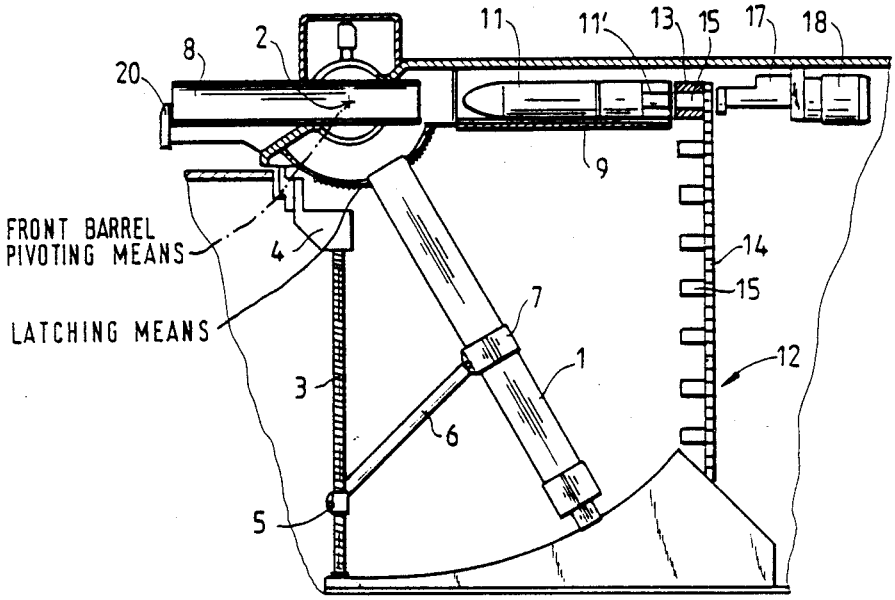
FIG. 1 illustrates, in partial section, a side view of a muzzle or front loader weapon.

A weapon barrel 1 is supported on a trunnion bearing mount 2 so as to be pivotable about an axis Y for enabling the setting of the elevation. For the setting of the elevation there is provided a threaded spindle 3 which is rotatable through the intermediary of an electric motor 4. A threaded sleeve 5 is seated on the threaded spindle 3, on which an elbow lever 6 has one end thereof hingedly connected therewith. The other end of the elbow lever 6 is hingedly connected with a ring 7 which is fastened to the weapon barrel 1. Upon rotation of the threaded spindle 3, the threaded sleeve 5 will displace such that the weapon barrel 1 is pivoted about the axis Y through the intermediary of the elbow lever 6.

Figure 2:
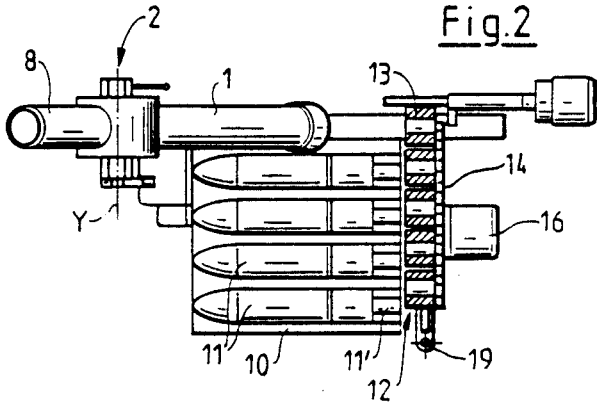
FIG. 2 illustrates a top plan view, partly in section, of the weapon.

On the trunnion bearing mount 2 there is also supported a front barrel segment 8 so as to be pivotable about axis Y. The barrel segment 8 can assume the loading position which is illustrated in FIG. 1. From this position the segment can be pivoted or swung into a firing position, in which it is coaxially aligned with the weapon barrel 1; as shown in FIG. 2 of the drawings.

Provision is made for a loading tray 9. The front weapon barrel segment 8 aligns with this loading tray when the former is in its loading position. The loading tray 9 has a first storage magazine 10 associated therewith, and which contains projectiles 11 of either the same or different types. In the adjoiningly located compartments of the magazine 10, in conformance with the represented number of compartments, there can be stored and selected from up to four different types of projectiles. Through the intermediary of a transport device (not shown) there can always be conveyed one of the projectiles 11 into the loading tray 9.

A further storage magazine 12 is provided herein, in which there are stored propellent charge components 13. The propellent charge components 13 each possess the same dimensions. However, the quantity of powder contained therein and their internal loading constructions can differ. The further storage magazine 12 is arranged directly behind the first storage magazine 10.

The further storage magazine 12 possesses a transport or conveyor chain 14 on which there are formed receiving or pick-up bolts 15 for the propellent charge components 13. The transport chain 14 is drivable by means of a stepping motor through an intermediate drive or gearing 16. The transport chain 14 is conducted in such a manner over sprocket wheels, that it conveys the propellent charge components 13 which are fitted on the pick-up bolts 15 along the side of the loading tray which is remote from the barrel segment 8.

A ramming or pusher head 17 is arranged on the side of the loading tray 9 which is remote from the barrel segment 8, which head is drivable by means of an electric motor 18. The propellent charge component 13 is constructed ring-shaped, in which its external diameter is approximately equal to the caliber of the projectile 11. The inner diameter of the propellent charge component 13 is configured such that it can be slid onto a stump 11' on the projectile 11. The pick-up bolt 15 is so configured that the propellent charge component 13 is slidable thereon by means of its inner diameter. The propellent charge component 13 does not necessarily contain the only propellent charge for the projectile 11. The projectile 11 can also be provided with a base propellent charge, which is complemented by the charge of the propellent charge component 13 deemed necessary for the individual or specific case. The storage magazine 12 for the propellent charge components 13 can be swung about an axis 19 away from the storage magazine 10, as is shown in FIG. 2. In that position it can be equipped with the propellent charge components 13.

The mode of operation of the above-described arrangement is generally somewhat as follows:

During the filling of the storage magazine 12, in essence, the plugging of the propellent charge components 13 onto the pick-up bolts 15 of the transport chain 14, information is stored in a computer (not shown) as to which type of propellent charge component is arranged at which location of the storage magazine 12.

When a projectile 11 which is selected for purpose of firing is then deposited on the loading tray 9 from the storage magazine, then under the control of the computer, the transport chain 14 is advanced by such an extent until a propellent charge component 13 which is suited for the necessary firing range is positioned intermediate the loading tray 9 and the pusher head 17. Thereafter, through the action of the pusher head 17, this propellent charge component 13 is slid off from the applicable pick-up bolt 15 and slid onto the projectile stump 11'. The pusher head 17 then accelerate the projectile 11 which is positioned in the loading tray 9 together with the slid on propellent charge component 13, such that the projectile 11 together with the propellent charge component 13 will be conducted into the front barrel segment 8 which stands in the loading position. A stop 20 ensures that the projectile 11 will not leave the front barrel segment 8. Preferably, the pusher head 17 is advanced by such an amount as to ensure that the projectile 11, together with the propellent charge component 13, will be completely positioned within the front barrel segment 8.

Thereafter, the barrel segment 8 is pivoted into the firing position in which it is in alignment with the weapon barrel 1 which, in the interim, has been oriented in conformance with the necessary firing elevation. The projectile 11, together with the propellent charge component 13, then drops downwardly into the weapon barrel 1. Upon striking against the lower end of the weapon barrel 1, the propellent charge is triggered. Thereafter, the weapon barrel segment 8 is again pivoted into its lower position and the herein described sequences are repeated.

Overall, it appears essential that propellent charge components which are suitable for the projectile 11 are stored in a further storage magazine 12. From this magazine there can be retrieved a selected propellent charge component 13 onto the side of the loading tray 9 which is remote from the front barrel segment 8. By means of a ramming or pusher device 17, 18, the propellent charge component 13 is pushable into the loading tray 9 onto the stump of the projectile, and the projectile 11 together with the propellent charge component 13 is insertable into the front barrel segment 8.

Instead of the separate sequentially effectuated movements in the supply of propellent charges 13 to the projectiles 11, it is naturally also possible to concurrently move the projectiles 11 and the propellent charges 13. This affords for a savings in time and a higher firing cadence for the weapon. As soon as the pusher 17 has reached its initial or starting position, there can already commence the transport or advance for the subsequent firing. The time which has been saved can then be utilized for the pivoting in of the barrel segment 8, for the dropping period of the projectile 11 and for the pivoting back of the barrel segment 8 into the loading position.

What is claimed is:

1. Automatic weapon comprising a muzzle-loadable weapon barrel which is settable into a least one firing elevation; a front barrel segment which is movable relative to the muzzle of said weapon barrel and, in one position of said front barrel segment, latchable in coaxial alignment with said weapon barrel, said front barrel segment being pivoted into a loading position in alignment with a loading tray for receiving a projectile from a first storage magazine and for loading said projectile into the front barrel segment; a propellent charge component for the projectile in said loading tray being stored in a further storaged magazine; transport means operatively associated with said further storage magazine for conveying a selected propellent charge member to the end of the loading tray which is distant from the front barrel segment; and a pusher device for sliding the propellent charge component against a projectile which is positioned on the loading tray and for causing the projectile in conjunction with the propellent charge component to be inserted into the front barrel segment in a loading position thereof in axial alignment with said loading tray, said projectile and propellent charge component dropping into the muzzle of said weapon barrel from said front barrel segment upon pivoting and alignment of said front barrel segment with said weapon barrel in an elevated position of the latter.

2. A muzzle loader weapon as claimed in claim 1, wherein the further storage magazine for the propellent charge components is arranged directly behind the storage magazine for the projectiles.

3. A muzzle loader weapon as claimed in claim 2, wherein said further storage magazine for the propellent charge component is pivotable about an axis to extend away from the storage magazine for the projectiles.

4. A muzzle loader weapon as claimed in claim 1, wherein said further storage magazine includes a transport chain mounting a plurality of said propellent charge components spaced along said transport chain; said transport chain facilitating the positioning of a selected propellent charge component between a projectile located on the loading tray and the pusher device.

5. A muzzle loader weapon as claimed in claim 4, wherein the transport chain includes pick-up bolts, said propellent charge components each being ring-shaped and having the inner circumference of each said ring-shaped propellent charge component supported on a respective pick-up bolt on said transport chain.

6. A muzzle loader weapon as claimed in claim 5, wherein the pusher device slides the selected propellent charge component off the pick-up bolt on which said propellent component is supported and onto a projectile stump of the projectile which is positioned on the loading tray.

7. A muzzle loader weapon as claimed in claim 1, wherein a ramming head of the pusher device slides the projectile in conjunction with the propellent charge component from the loading tray into the front barrel segment which is in a coaxial aligned position with said loading tray.

* * * * *